US008327558B2

(12) United States Patent
Hu

(10) Patent No.: US 8,327,558 B2
(45) Date of Patent: Dec. 11, 2012

(54) SHED TYPE CLOTHES DRYER WITH SAFETY PLATE

(76) Inventor: Jiebo Hu, Zhejiang (CN)

( * ) Notice: Subject to any disclaimer, the term of this patent is extended or adjusted under 35 U.S.C. 154(b) by 575 days.

(21) Appl. No.: 12/449,446

(22) PCT Filed: Feb. 3, 2008

(86) PCT No.: PCT/CN2008/000291

§ 371 (c)(1),
(2), (4) Date: Aug. 7, 2009

(87) PCT Pub. No.: WO2008/098479

PCT Pub. Date: Aug. 21, 2008

(65) Prior Publication Data

US 2009/0307923 A1 Dec. 17, 2009

(30) Foreign Application Priority Data

Feb. 9, 2007 (CN) ..... 2007 1 0079213

(51) Int. Cl.
*F26B 25/00* (2006.01)

(52) U.S. Cl. ..... 34/210; 34/218; D32/8; 68/3 R; 68/5 R

(58) Field of Classification Search ..... 34/70, 80, 34/90, 201, 202, 210, 218; 68/3 R, 5 R; D32/1, D32/8
See application file for complete search history.

(56) References Cited

U.S. PATENT DOCUMENTS

| | | | | |
|---|---|---|---|---|
| 5,755,040 | A * | 5/1998 | Ou | 34/202 |
| 6,018,885 | A * | 2/2000 | Hill | 34/202 |
| 6,840,068 | B2 * | 1/2005 | Pasin et al. | 68/5 C |
| 7,063,220 | B2 * | 6/2006 | Jackson | 211/119.01 |
| 7,191,546 | B2 * | 3/2007 | Maruca | 34/201 |
| D553,310 | S * | 10/2007 | Penney et al. | D32/8 |
| 8,104,192 | B2 * | 1/2012 | Myung et al. | 34/601 |
| 2002/0053607 | A1 * | 5/2002 | Gaaloul et al. | 239/102.2 |
| 2008/0222909 | A1 * | 9/2008 | Picozza et al. | 34/195 |

* cited by examiner

*Primary Examiner* — Stephen M. Gravini
(74) *Attorney, Agent, or Firm* — Raymond Y. Chan; David and Raymond Patent Firm

(57) ABSTRACT

A shed type clothes dryer, especially a shed type clothes dryer with safety ventilating member is disclosed. The shed type clothes dryer with safety ventilating member includes a heat blower, air outlet shed with plural air outlets which are set on the heat blower, umbrella shape support frame with center supporting stand which is set on the air outlet shed, clothes drying chamber formed from outer cover around the support frame. The safety ventilating member is set on the air outlet shed. A hot air relaxation chamber is formed between said safety ventilating member and the air outlet shed. The shed type clothes dryer with safety ventilating member has the following advantages: 1. mounted safety ventilating member preventing the clothes from falling on hot air port to make consumer securely use it, 2. automatically stopping after the clothes been dried by humiture probe controlling the humiture to ensure the clothes not over drying and energy saving, 3. the temperature of the hot air current let in the clothes drying chamber being uniform at each position, and the air current being mild, thus obtaining excellent clothes drying effect.

20 Claims, 10 Drawing Sheets

SHED TYPE CLOTHES DRYER WITH SAFETY PLATE

BACKGROUND OF THE PRESENT INVENTION

1. Field of Invention

The present invention relates to a warm air exhaust clothes drying machine, and more particularly to a safe clothes drying machine using a sealing cover made of soft material, wherein the heat source is located at the bottom of the sealing cover while the water vapor is exhausted at the top of the sealing cover.

2. Description of Related Arts

Modern technology promoted the modern human beings civilization and life styles. A wide range of reliable daily necessities for assisting human life are satisfying the needs of human daily life.

People are wearing variety of shapes and textures clothes everyday for the social activities. After finished the busy day, taking off the dirty clothes for washing and drying is the thing that they have to do after going home or going back to the hotel. Traditionally, people are used to dry their clothes under the sun. However, the citizens living in a city with tall buildings residential area may not be able to get much sun light. Therefore, there is a great need of a safe dryer as one of the electronic appliances to replace the naturally drying the clothes via the sun light.

In recent years, those skilled in the art developed a simple cloth covered warm air exhaust clothes drying machine. There is competition to develop a wave of low-priced, novel, and scientific clothe drying tools to meet the needs of the people.

The following clothes drying machines were found through a patent search:

China patent CN98234374.4 disclosed a clothes drying machine.

China patents CN99226450.2 disclosed a rapid clothes drying cabinet.

China patent CN02272023.5 disclosed a clothes drying machine.

China patent CN200420014883.3 a warm air clothes drying machine.

The common features of the above disclosed clothes drying machines are:

First advantage: The connecting column for the inside of the clothes drying chamber is in the form of a central column-type primary pole. A top bracket is connected to the top of the primary pole. The bottom of the primary pole is slipped into the center of the exhaust mechanism at the bottom. The bottom surface of the exhaust plate has a plurality of support pieces to suspendedly support the whole body of the clothes drying machine. This advantage is easily for manufacturing and installation, so that the cost is relatively lower.

Second advantage: Those China Patents CN98234374.4, CN99226450.2, and CN02272023.5 disclosed a clothes drying machine with an umbrella shaped structure for hanging the clothes, the structure is foldably between a supporting and storing position, and able to support the hanging clothes, so as to solve the problem of hanging clothes within the clothes drying chamber.

Third advantage: China patens CN99226450.2, CN02272023.5, and CN200420014883.3 disclosed that the cloth cover for preventing leakage of warm air is made of a heat resistant and soft material. A zipper for adding and removing clothes is disposed at the front of the cloth cover.

The advantages of such a covering are low cost of manufacture, excellent ability to prevent leakage of warm air, and convenience of use.

Fourth advantage: China patens CN99226450.2, CN02272023.5, and CN200420014883.3 disclosed that warm air is blow through the exhaust plate at the bottom of the central support column. The warm air rises into the clothes drying chamber. Such a structure takes full advantage of the physical phenomenon of the rising of warm air and benefits the drying of clothes.

First drawback: As disclosed in CN02272023.5 and CN20040014883.3, the exhaust port is around the bottom of the primary pole. A person skilled in the art knows through analysis or use that the temperature just outside the exhaust port is high. If a user uses a clothes drying machine of such a structure to dry long clothes, the bottom of the clothes will be close to the exhaust port, and the high temperature current from the exhaust port will damage the clothes and cause the user to sustain losses.

Second drawback: Using the above exhaust port structure for a clothes drying machine, if a large article of clothing slides from the hanger during use of the machine, and the article of clothing falls on the central exhaust port and blocks the port, then the high temperature current is concentrated at the exhaust plate, burning the article of clothing and possibly causing a fire.

In addition, the china patent 98234374.4, around the primary pole has a pole hole and an air outlet, so that the high temperature current is blown out from the air outlet. Therefore, such structure can cause the same problem of the high temperature current from the small pole hole to damage the clothes.

There is another problem of China patent 99226450.2. A heating fan at one end of the pole hole is adapted to blow the high temperature current, and through a sealing tube to blow into the exhaust shed at the bottom of the pole. The high temperature current is further blown into the clothes drying chamber from an outlet of the exhaust shed. The structure has the same safety problem as the first drawback.

Therefore, the safety of the above of the pole supporting structure of the simple clothes drying machine has to be improved to widely popularize the machine.

Application CN200610109222.2, titled "A Cabinet-type Clothes Drying Machine" (illustrated in FIG. 1) and by the present inventor, discloses a cabinet-type clothes drying machine, wherein warm air buffer chamber partitioning board 16 forms warm air buffer chamber 15 above warm air tunnel protection board 14, and humidity probe 12 and temperature probe 13 are used to calibrate the temperature and humidity controlling heater for the warm air buffering chamber and the clothes drying chamber. Because the cabinet-type clothes drying machine comprises a warm air buffering chamber partitioning board 16 disposed above the warm air tunnel protection board 14 and a temperature probe 12, the invention solves the problems of damaging the dried clothing and the high temperature current damaging articles of clothing and causing a fire in the case of an article of clothing falling onto the exhaust port. The features are: 1. The warm air buffering chamber is made of a cloth cover, and the straight support columns are supported by the bottom casing. 2. The structure is relatively complex, and installation is complex. 3. The current generator is on one side of the bottom casing, and the cross section for current flowing from the air tunnel is limited. In other words, part of the space is occupied by the current generator, and there is some positional bias in the air in the warm air buffering chamber, creating a low temperature section above the current generator in the warm air buffering chamber and the clothes drying chamber and high temperature sections above the openings for current flow.

Application CN200620018906.7 by the present inventor discloses a tent-shaped clothes drying machine (illustrated in FIG. 2), comprising support bracket 6 and heater 1 mounted on support bracket 6. An arch-shaped exhaust dome 2 is mounted at the top of the heater 1. A lower support pipe 5 is connected to the trough axis of the arch-shaped exhaust dome 2, and an upper support pipe 4 is connected to the lower support pipe 5. The features are: Current guiding flakes 3 are evenly disposed around exhaust port 9 of the arch-shaped exhaust dome, a waterproof cover 10 is disposed on the arch-shaped exhaust dome and below the lower support pipe 5, and the bottom of the support bracket 6 comprises integral support legs 7, each support leg 7 having a wheel 8. The current guiding flakes in the invention successfully guide the warm air and improve the current flow. The warm air current does not cascade horizontally but flow upward, thus achieving excellent drying with low energy expenditure. Heat resistant and low heat-conducting plastic current guiding flakes remain within safe temperatures during use, firmly support the support pipes, and does not allow conduct the high temperature from the exhaust dome to the upper support pipe. The wheels allow movement of the clothes drying machine and provide convenience. The upper support pipe and the lower support pipes are connected via a screw mechanism, allowing for easy storage. The tent-shaped clothes drying machine has a low price, $25 each, and falls within the consumptive powers of the general population. However, the safety of the machine is inferior. The same problem of high temperature current damaging the clothing exists. The important problems are: 1. The outer perimeter surrounding the warm air exhaust port is made of a cloth cover, but the cloth cover has low rigidity. During use, a child who inadvertently displaces the cloth cover may be burned. 2. There is a column in the middle of the clothes drying chamber that occupies room in the clothes drying chamber, introducing difficulties in hanging large articles of clothing and leaving cooling clothes.

SUMMARY OF THE PRESENT INVENTION

A main object of the present invention to solve the above problems in the prior art by providing a safe clothes drying machine with a tent-shaped clothes drying machine, so that a pole supported type of clothes drying machine can dramatically enhance the safety. The safety of this type of drying machine is able to achieve the national safety stander, such that the product of the present invention is able to be used for every family and hotel. Thus, the consumers and managers can have the confidence to use the machine.

Accordingly, in order to accomplish the above object, the present invention is practiced as followings:

A shed type clothes dryer with a safety ventilating member, which comprises a heat blower, an air outlet shed with at least one air outlet provided at the heat blower, an umbrella shaped support frame with a center supporting stand provided at the air outlet shed, and a clothes drying chamber formed around the peripheral of the support frame.

A safety ventilating member is provided above the air outlet shed, wherein an air buffer chamber is formed between the safety ventilating member and the air outlet shed.

The air outlet shed has an arch shape, wherein a plurality of air outlets are radially and symmetrically provided at a peripheral edge of the arch shaped air outlet shed, wherein a plurality of guiding members are provided at two sides of each of air outlets, wherein a water proof cover is provided at an upper side of the air outlet shed of the heat blower. The diameter of the water proof cover is larger than the diameter of the air outlet shed.

The shed type clothes dryer of the present invention has an outer cover supported by the support frame, wherein the outer cover has two portions. The first lower portion of the outer cover is a permanently sealed flexible outer cover encircling at the air buffer chamber. The second upper portion of the outer cover is a flexibly re-closable outer cover encircling the clothes drying chamber, wherein an opening door is provided at the flexibly re-closable outer cover for communicatively accessing the clothes therewithin, wherein an air exhaust top cover is further provided at the top side of the re-closable outer cover at the clothes drying chamber.

The safety ventilating member is a rigid circular plate having a plurality ventilating holes evenly distributed thereon. Or, the safety ventilating member comprises a circular affixing ring and a flexible air-meshed cloth affixed to the affixing ring in a tensional manner. Or, the safety ventilating member comprises a circular affixing ring and a netted screen affixed to the affixing ring in a tensional manner.

The safety ventilating member comprises a center support apparatus, wherein the safety ventilating member is adjustably affixed on top of the air outlet shed via the center support apparatus to adjust a height of the safety ventilating member above the air outlet shed.

The center support apparatus is made of plate material to form a barrel shaped support seat, wherein the barrel shaped support seat is located within the air outlet at peripheral edge of the top of the air outlet shed. Or, the center support apparatus is made of pole shaped material to form a cage-shaped support seat, wherein the cage shaped support seat is provided outside the air outlet circumferentially distributed on the top of the air outlet shed.

A peripheral supporting apparatus is provided at the peripheral edge of the safety ventilating member, wherein the safety ventilating member is mounted on the outer cover of the support frame via the peripheral supporting apparatus.

The peripheral supporting apparatus is a plurality of positioning posts evenly distributed along the peripheral edge of the safety ventilating member, wherein a plurality of positioning holes is provided within the outer cover at a position corresponding to a height of the outer cover, wherein the safety ventilating member is mounted on the air outlet shed via inserting the positioning posts into the positioning holes within the outer cover. Or, the peripheral supporting apparatus comprises a stitching element affixing the safety ventilating member within the outer cover by stitching.

A plurality of pedestals are evenly provided under the heat blower, wherein a water proof cover on top of the air outlet shed is set on the center supporting stand.

A temperature and humidity sensor is further provided, wherein the temperature and humidity sensor is electrically connected to an electronic controller.

The rigid circular plate is made from metal sheet having a thickness from 0.2 mm to 4 mm by sheet metal stamping or by plastic molding injection, wherein a surface of the rigid circular plate has a waving shape or any other stereo structure with bumping combinations to enhance an overall strength of the rigid circular plate structure while providing a plurality of conducting holes cloudily distributed thereon.

A first water proof zone is provided at a center portion of the safety ventilating member, wherein the first water proof zone is a non-holed zone, wherein a radius of the first water proof zone is larger than an outer radius of the air outlet shed, wherein the first water proof zone has a protruding convex surface protruded toward the clothes drying chamber.

The present invention has the following advantages:

1. A safety ventilating member is provided for clothes dryer to divide the chamber within the clothes dryer into two portions, which is benefit to prevent a long shaped clothes directly contacting with the air outlet while being hung within the chamber. Even if the clothes hanging in the chamber is slipped and dropped on the air outlet or covering the air outlet, the clothes will be caught by the safety ventilating member, so as to enhance the safety for human beings and prevent the dangers that may occur. Therefore, those cloths covering type dryer can be widely popularized and the consumer can use the product without worries.

2. Through the safety ventilating member, the present invention achieves the heated air current from the air outlet flows to a relatively larger space of the air buffer chamber, so that the heated air current from the air outlet is able to evenly distribute and mix with the lower temperature air current in the air buffer chamber without directly flowing the heated air current towards the hanging clothes. Also, a temperature sensor may further be provided at the air buffer chamber to accurately measure the temperature in the air buffer chamber through a central controller, so that the drying temperature and process can be adjustably controlled according to the type of the clothes. Furthermore, the dryness of the clothes in the clothes drying chamber can be controlled via the temperature and humidity sensor through the central controller, so that after drying the clothes, the drying process may be automatically stopped in responsive to the dryness measured by the sensor, so as to prevent over drying the clothes and save energy.

3. The safety ventilating member, having a plurality of air ventilating holes, is able to guide the heated air current in the air buffer chamber smoothly entering the clothes drying chamber, so that the temperature of the heated air current in the clothes drying chamber is relatively more even. Thus, the air current is relatively more stable, so as to have relatively higher quality of drying clothes.

These and other objectives, features, and advantages of the present invention will become apparent from the following detailed description, the accompanying drawings, and the appended claims.

DETAILED DESCRIPTION OF THE PREFERRED EMBODIMENT

First Preferred Embodiment of the Present Invention

Figure 1:
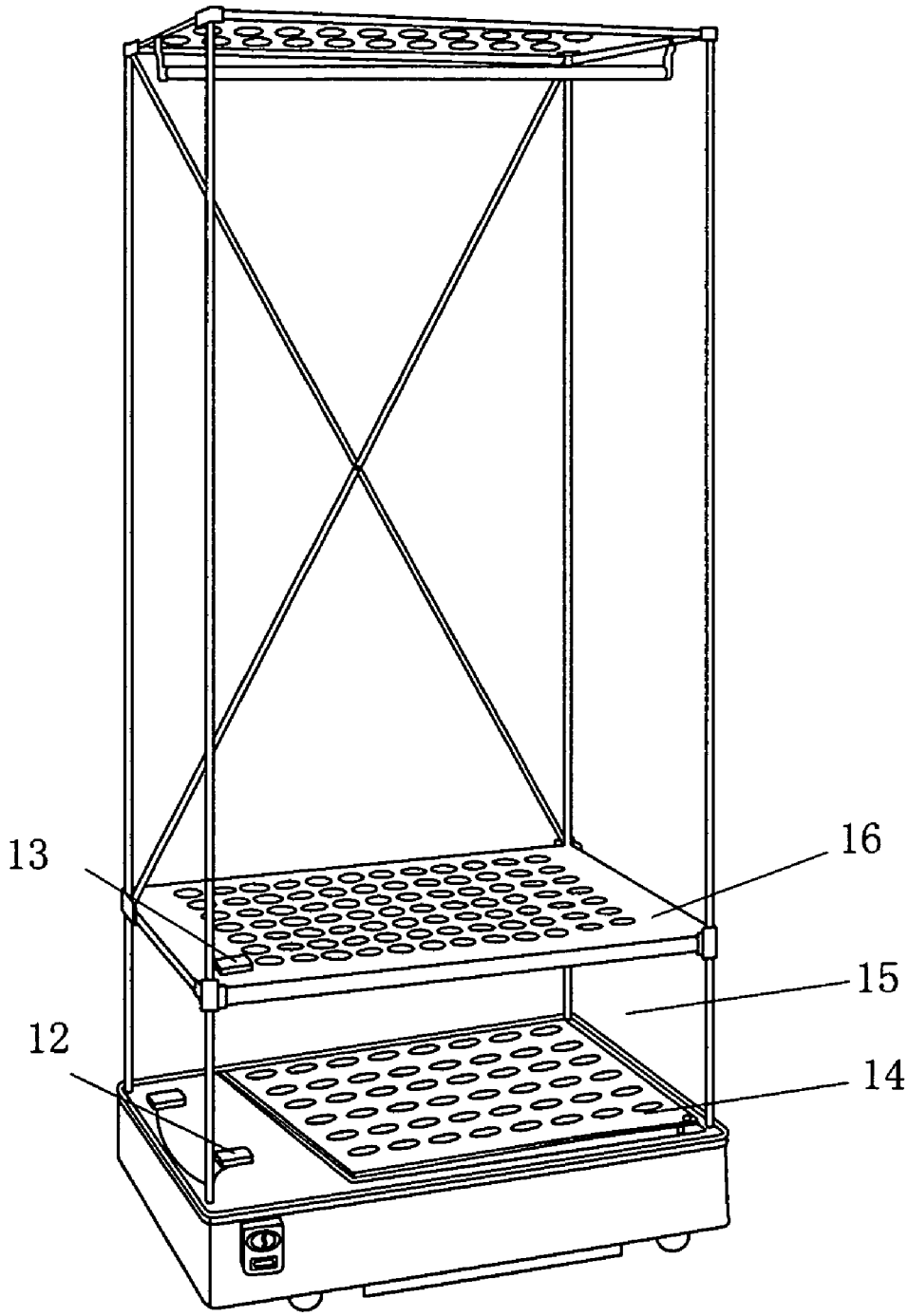
FIG. 1 is a perspective view of the conventional clothes dryer without an outer cover.
Figure 2:
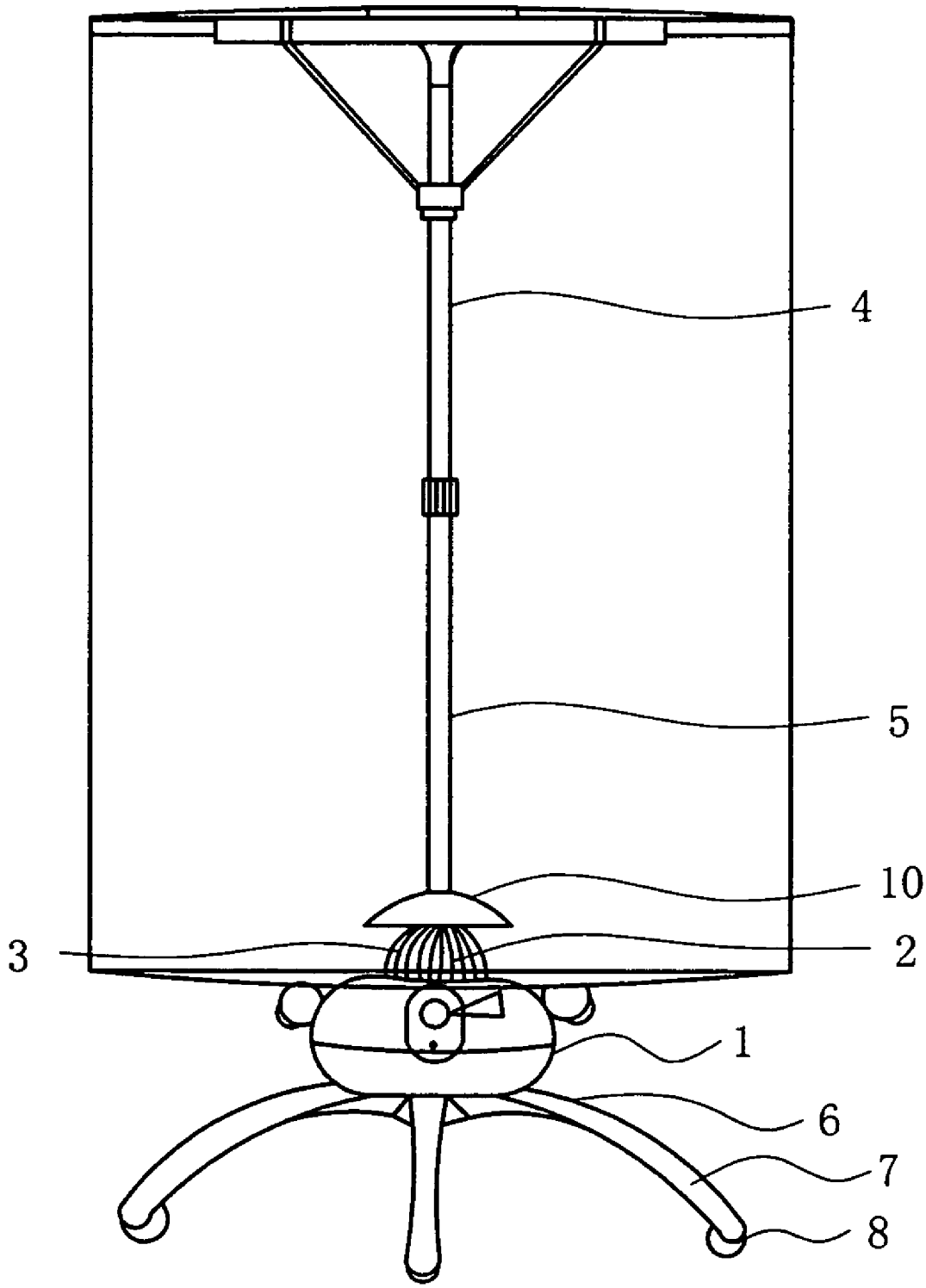
FIG. 2 is a schematic view of the conventional clothes dryer.
Figure 3:
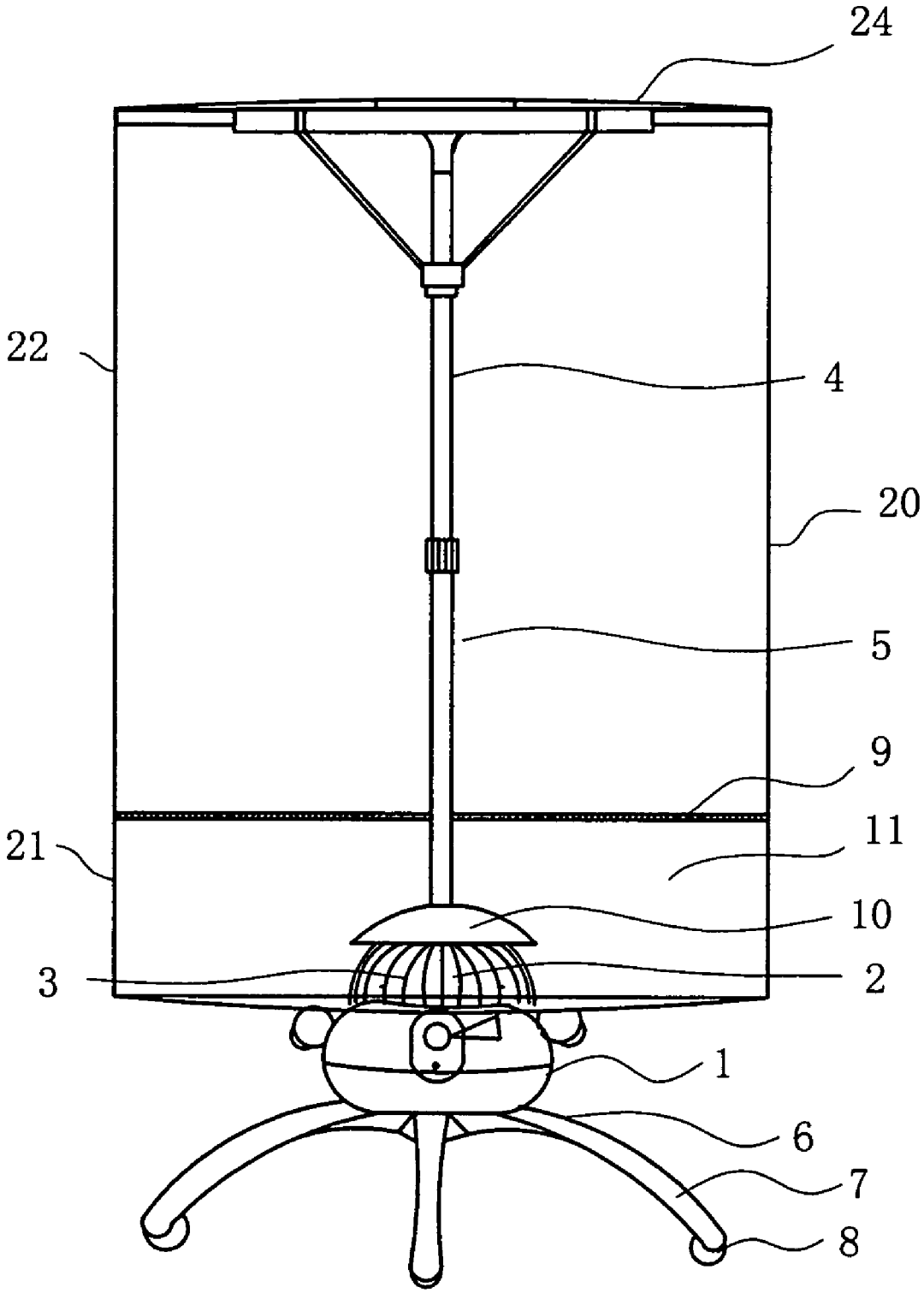
FIG. 3 is a schematic view of a shed type clothes dryer with a safety ventilating member according to a preferred embodiment of the present invention.
Figure 4:
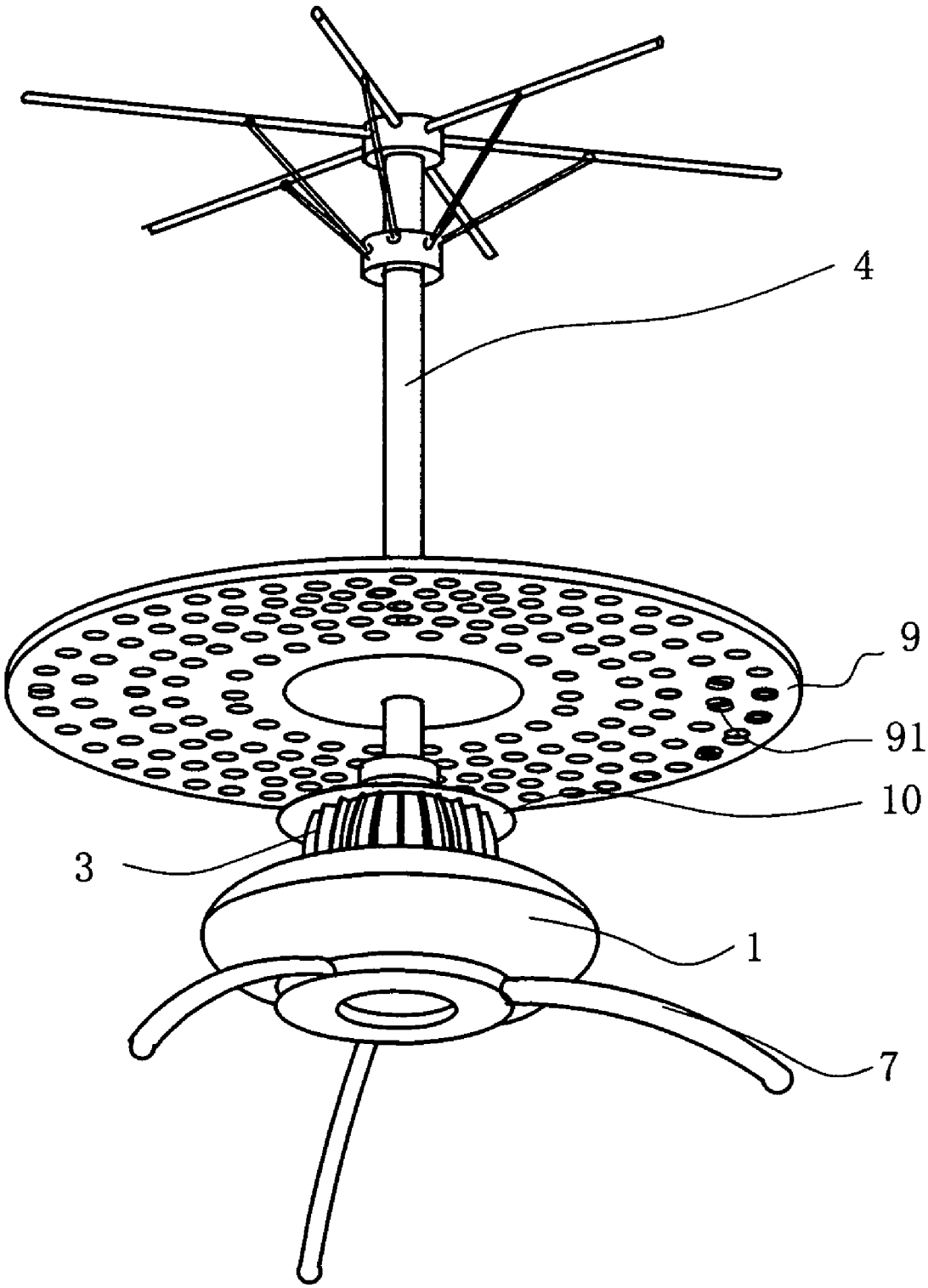
FIG. 4 is a perspective view of the safety ventilating member of the shed type clothes dryer according to the above preferred embodiment of the present invention.

As shown in FIGS. 3 and 4 of the drawings, the present invention provides a shed type clothes dryer, wherein the shed type clothes dryer comprises a heat blower 1 for generating a heated air flow, an air outlet shed 3 with a plurality of air outlets 2 provided on top of the heat blower 1, an umbrella shaped support frame 4 with a center supporting stand 5 upwardly extended from the air outlet shed 3, and an outer cover 20 encirclingly supported at the support frame 4 to form a clothes drying chamber 17.

The shed type clothes dryer further comprises a safety ventilating member 9 provided above the air outlet shed 3, wherein an air buffer chamber 11 is formed between the safety ventilating member 9 and the air outlet shed 3.

Figure 12:
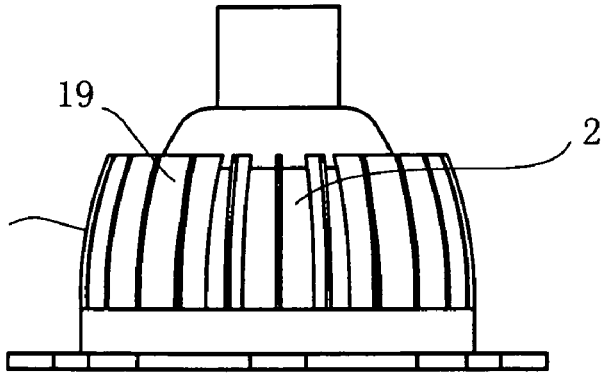
FIG. 12 is a side view of an air outlet shed of the shed type clothes dryer according to the above preferred embodiment of the present invention.

The air outlet shed 3 of the present invention mainly uses an existing arch shaped air outlet shed. As shown in FIG. 12, the air outlets 2 are radially and symmetrically provided along the peripheral edge of the top of the arch shaped air outlet shed 3. A plurality of guiding members 19 are provided at two sides of each of the air outlets 2, wherein each of the guiding members 19 having a planar shape is able to successfully guide the heated air out of the air outlet 2, so as to enhance the air circulating effect. The guiding members 19 are preferably made of heat durable material with low conductivity property. The temperature of the guiding members 19 is below the safety temperature range while working. The guiding members 19 can also stably support the center supporting stand 5 without transferring the heat within the air outlet shed 3 to an upper portion of the center supporting stand 5.

Figure 13:
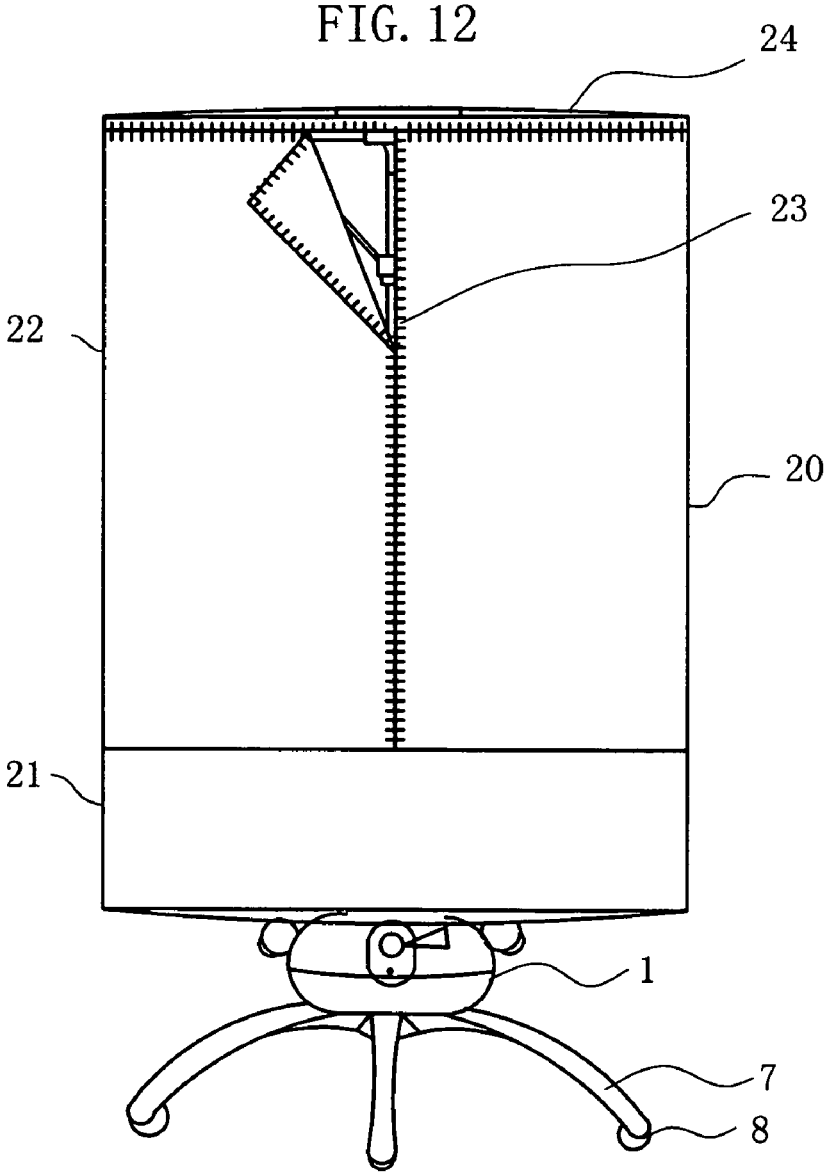
FIG. 13 is a side view of an outer cover of the shed type clothes dryer according to the above preferred embodiment of the present invention.

The outer cover 20 supported via the support frame 4 is formed from two portions 21, 22. The first lower portion of the outer cover 20 is a permanently sealed outer cover 21 permanently encircling around the air buffer chamber 11. The second upper portion of the outer cover 20 is a flexibly re-closable outer cover 22 encircling around the clothes drying chamber 17. An opening door 23 is provided at the flexibly re-closable outer cover 22 for communicatively accessing the clothes within the clothes drying chamber 17 (as shown in FIG. 13). An air exhaust top cover 24 is further provided at the top of the re-closable outer cover 22 at the clothes drying chamber 17.

The safety ventilating member 9 of the preferred embodiment of the present invention comprises a rigid circular plate having a plurality ventilating holes 91 evenly distributed thereon (as shown in FIG. 4), wherein the rigid circular plate may be made from metal sheet having a thickness from 0.2 mm to 4 mm by sheet metal stamping or made by plastic molding injection. In order to enhance the overall strength of the rigid circular plate structure, the surface of the rigid circular plate may form a waving shape or any other stereo structure with bumping combinations while keeping the plurality of the ventilating holes 91.

Figure 14:
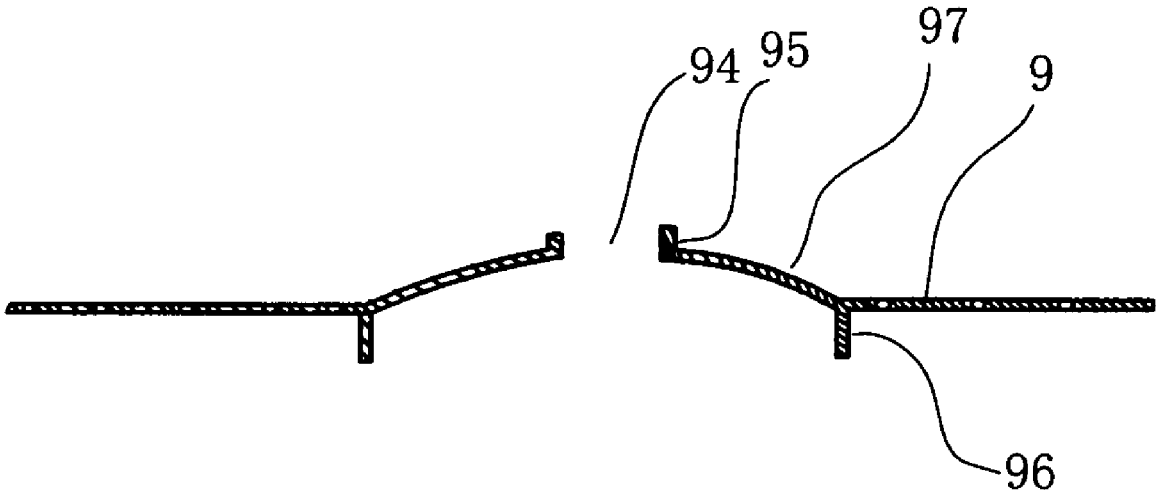
FIG. 14 is sectional view of a water proof structure of the safety ventilating member according to the above preferred embodiment of the present invention.

Also referring to FIG. 14, a center hole 94 is further provided at a center portion of the safety ventilating member 9 for the center supporting stand 5 slidably inserted through the center hole 94. The center portion of the safety ventilating member 9 formed a non-holed water proof zone 97 extended from the peripheral edge of the center hole 94, also called the first water proof zone (corresponding to the water proof cover at the lower part of the clothes dryer). The radius of the first water proof zone 97 is larger than the radius of the air outlet shed 3. Accordingly, the first water proof zone 97 may have a protruding convex surface to protrude toward the clothes drying chamber 17.

The ventilating holes 91 are evenly distributed on the safety ventilating member 9 out of the non-holed water proof zone 97. In order to prevent the water of wet clothes dropped onto the non-holed water proof zone 97 of the safety ventilating member 9, and then dripped into the heat blower 1 along the center supporting stand 5 through the center hole 94, a water proof ridge 95 is upwardly extended at the peripheral edge of the center hole 94 to couple with the center supporting stand 5. Likewise, in order to prevent the water of wet clothes dropped onto the non-holed water proof zone 97 of the safety ventilating member 9, then flows toward the center portion from the ventilating hole 91, and then flow into the heat blower 1, a water guiding ridge 96 is downwardly extended from the bottom side of the safety ventilating member 9 at the peripheral edge of the non-holed water proof zone 97. A diameter of the water guiding ridge 96 should be larger than the maximized diameter of the arch part of the arch shaped air outlet shed 3. Also a water proof cover 10 is provided at the top of the air outlet shed 3 of the heat blower 1, wherein the water proof cover 10 is preferably larger than the outer diameter of the air outlet shed 3. A conducting slot is further provided on the arch shaped air outlet shed 3 at a position corresponding to the location of the water proof cover 10 to conduct the water flow from the air outlet shed 3 to the bottom side of the heat blower 1, so as to flow out of the clothes dryer.

Figure 5:
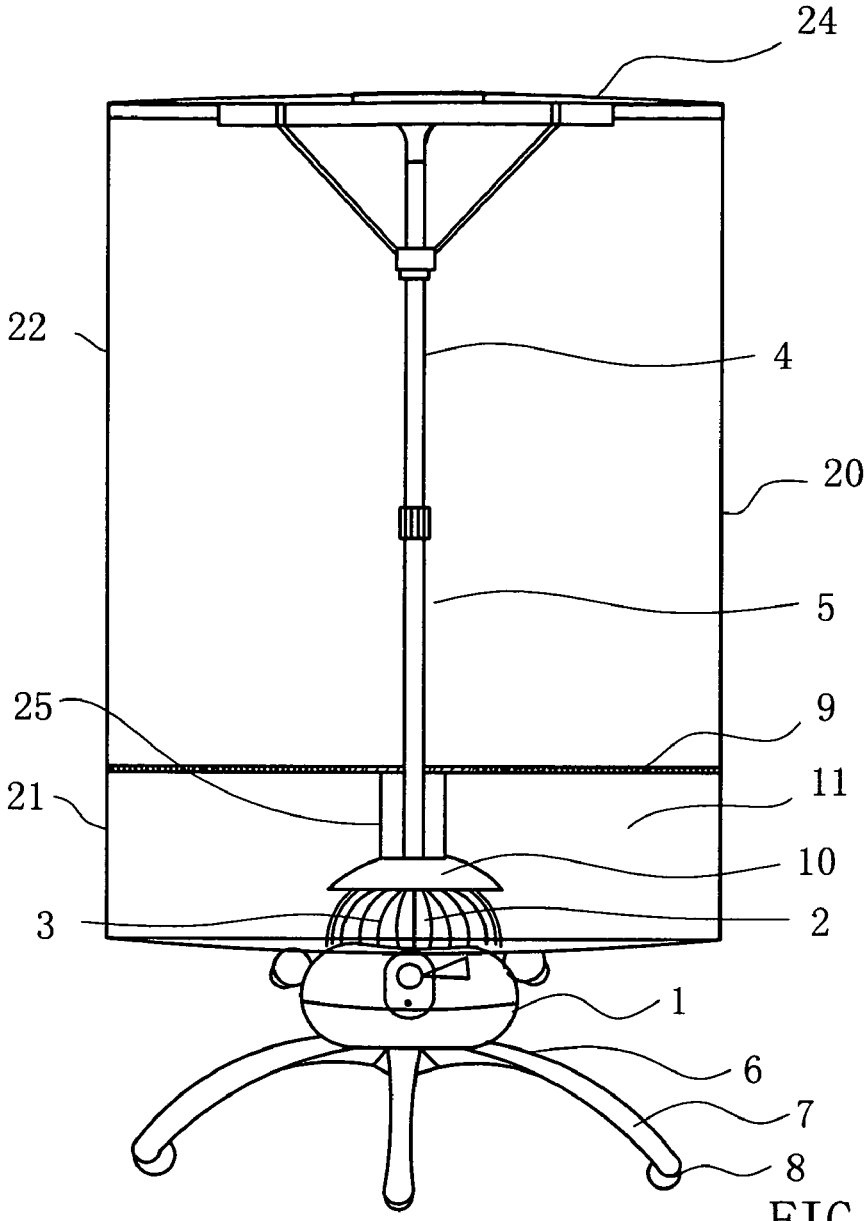
FIG. 5 is a sectional view of the shed type clothes dryer according to the above preferred embodiment of the present invention, illustrating the supporting apparatus of the safety ventilating member.
Figure 6:
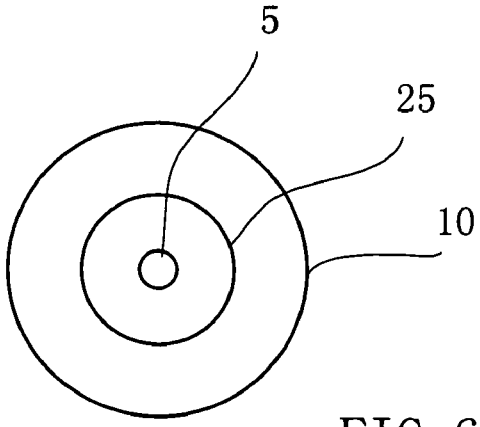
FIG. 6 is a sectional view of the supporting apparatus of the shed type clothes dryer according to the above preferred embodiment of the present invention.

The safety ventilating member 9 as mentioned in the preferred embodiment is also shown in FIGS. 5 and 6. A center support apparatus is provided underneath the safety ventilating member 9, wherein the safety ventilating member 9 is mounted on the top of the air outlet shed 3 through the center support apparatus. As shown in the figures of the preferred embodiment, the center support apparatus is made of plate material to form a barrel shaped support seat 25. The barrel shaped support seat 25 is located within the air outlet at the peripheral edge of the top of the air outlet shed 3, as shown in FIG. 6, so as to prevent the heated air from the air outlet shed 3 being blocked. In the present preferred embodiment, the water proof cover 10 located on the top of the air outlet shed 3 is set on the barrel shaped support seat 25.

Second Preferred Embodiment of the Present Invention

Figure 7:
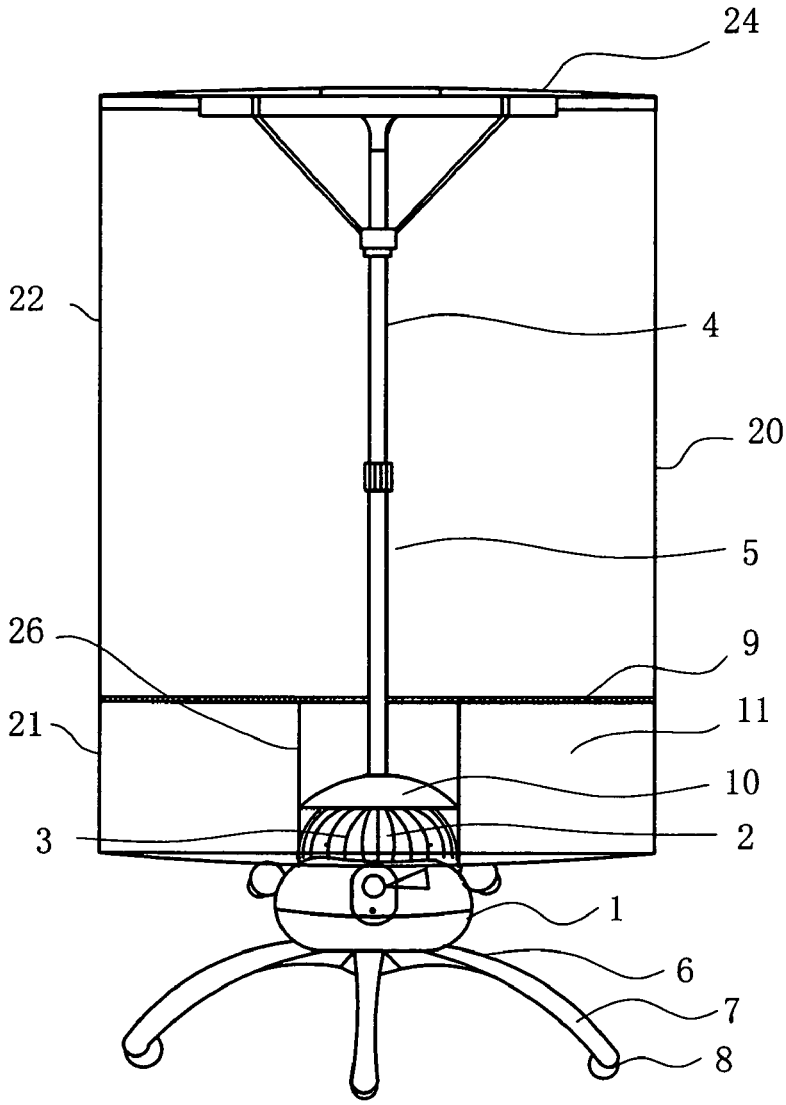
FIG. 7 illustrates an alternative mode of the supporting apparatus for the safety ventilating member according to the above preferred embodiment of the present invention.
Figure 8:
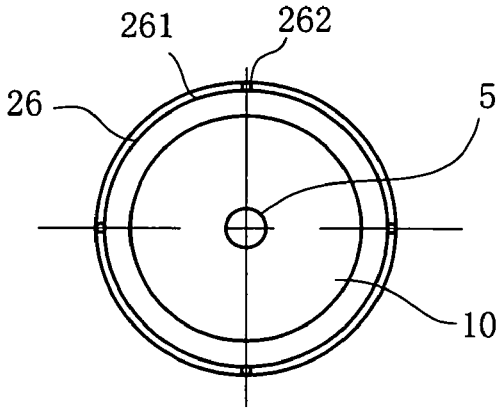
FIG. 8 is a sectional view of the alternative supporting apparatus for the safety ventilating member according to the above preferred embodiment of the present invention.

Referring to FIGS. 7 and 8 of the drawings, another embodiment of safety ventilating member 9 illustrates as an alternative mode thereof. Basically the overall of the second preferred embodiment is substantially the same as the first preferred embodiment, beside the structure of the center support apparatus. As shown in FIGS. 7 and 8, the center support apparatus of the presently preferred embodiment is made of pole shaped material to form a cage shaped support seat 26, wherein the cage shaped support seat 26 is formed via upper and lower circular rings 261 and a plurality of connection poles 262 connecting the upper and lower circular rings 261. The cage shaped support seat 26 is not blocking the heated air from the air outlet shed 3, so that the support seat 26 may be provided at the air outlet circumferentially distributed on the top of the air outlet shed 3. In the presently preferred embodiment, the water proof cover 10 on the top of the air outlet shed 3 is set on the center supporting stand 5.

Third Preferred Embodiment of the Present Invention

Figure 9:
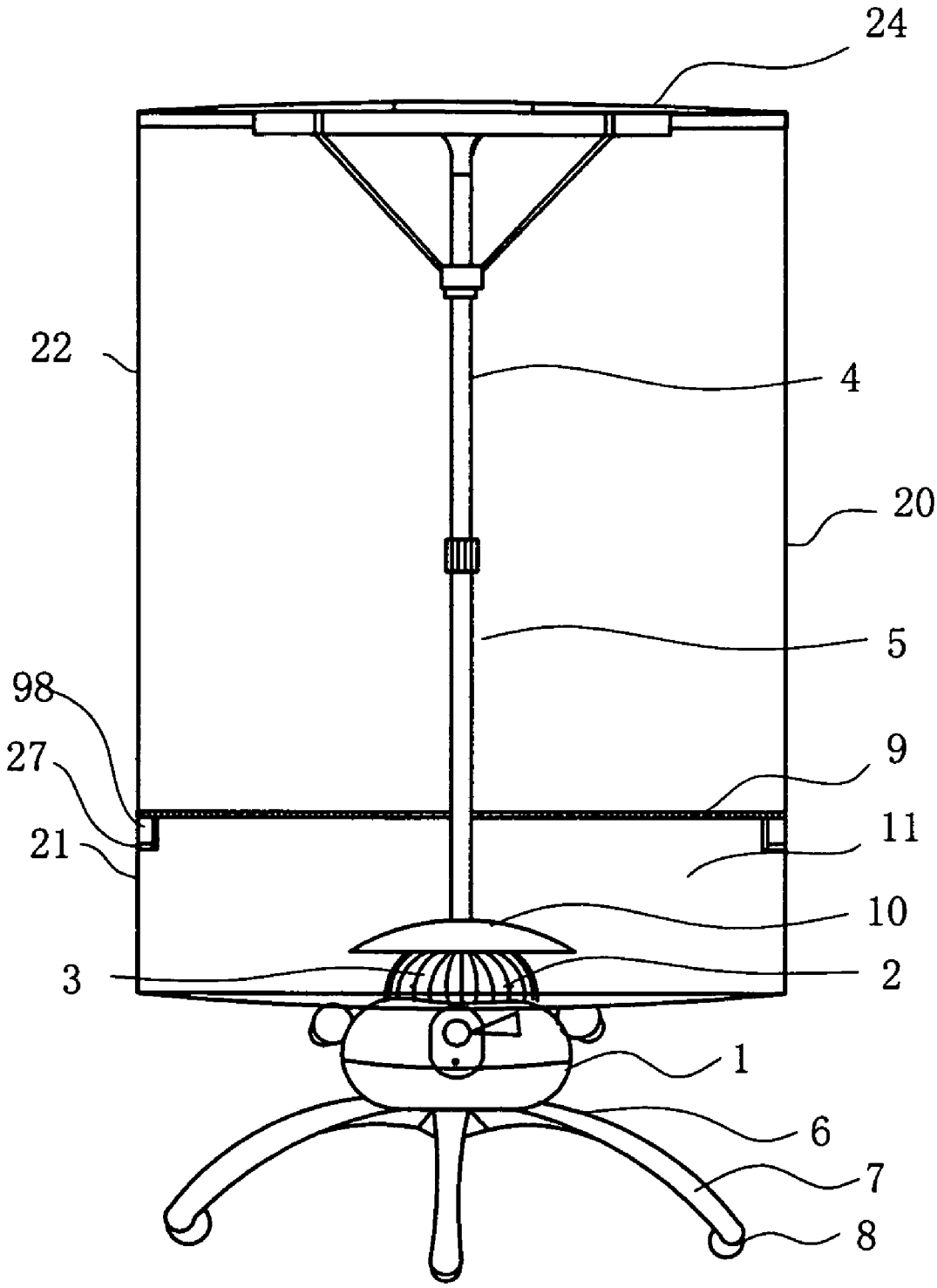
FIG. 9 illustrates a second alternative mode of the supporting apparatus for the safety ventilating member according to the above preferred embodiment of the present invention.

Referring to FIG. 9, another mounting method of the safety ventilating member 9 of the shed type clothes dryer with safety ventilating member of the present invention is illustrated, wherein a peripheral supporting apparatus is provided at the peripheral of the safety ventilating member 9, wherein the safety ventilating member 9 is mounted on the outer cover of the support frame via the peripheral supporting apparatus. More specifically, the peripheral supporting apparatus is a plurality of positioning posts 91 evenly distributed along the peripheral edge of the safety ventilating member 9. A plurality of positioning holes 27 is provided within the outer cover at a position corresponding to the height of the outer cover 20. The safety ventilating member 9 is mounted on the air outlet shed 3 via inserting the positioning posts 91 into the positioning holes 27 within the outer cover 20.

Fourth Embodiment of the Present Invention

Figure 10:
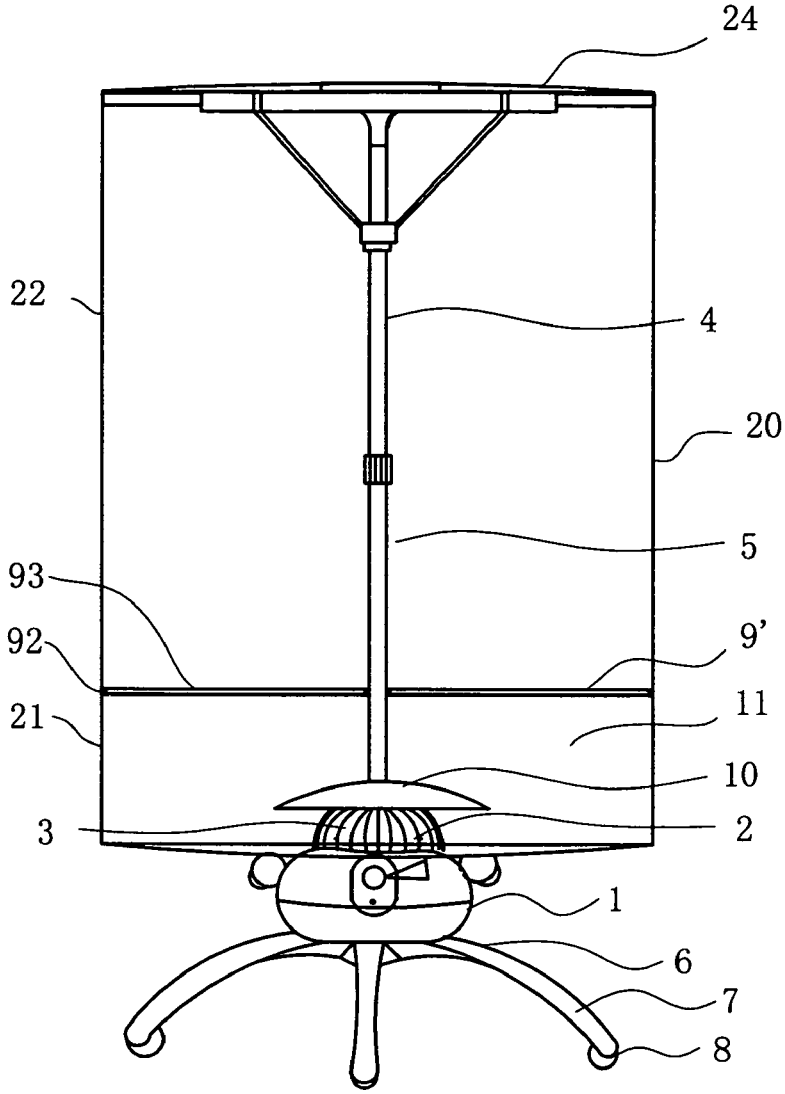
FIG. 10 illustrates a third alternative mode of the supporting apparatus for the safety ventilating member according to the above preferred embodiment of the present invention.
Figure 11:
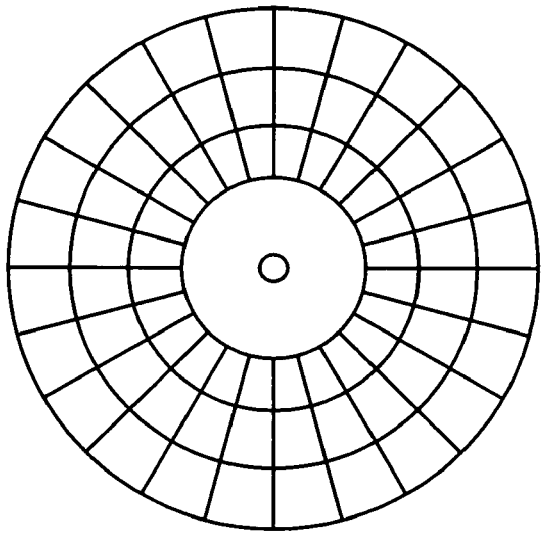
FIG. 11 is a perspective view of a screen type safety ventilating member according to the above preferred embodiment of the present invention.

Referring to FIG. 10 of the drawing, another mounting method of the safety ventilating member 9 of the shed type clothes dryer with safety ventilating member of the present invention is illustrated. In the presently preferred embodiment, the safety ventilating member 9' comprises a circular affixing ring 92 and a flexible air-meshed cloth 93 affixed on the affixing ring 92 in a tensional manner, so as to form the safety ventilating member 9' with air ventilating function. Or, the safety ventilating member 9 comprises via the circular shaped affixing ring and a netted screen affixed thereon in the tensional manner to form the safety ventilating member 9' with air ventilating function. The present invention of mesh cloth type safety ventilating member or the screen type safety ventilating member is affixed in the outer cover 20 via the peripheral supporting apparatus, and more specifically is to affix the circular shaped affixing ring of the safety ventilating member 9 within the outer cover 20 by a stitching element through sewing or stitching method, or via the positioning poles and positioning hole as mentioned in the third preferred embodiment.

The safety ventilating member 9 used in each of the above preferred embodiments may also adapts a wire shaped material welded with each other to form a net structural safety ventilating member. The wire net may be further provided on the net structural safety.

A plurality of pedestals 7 are evenly provided under the heat blower 1, wherein the pedestals 7 may be affixed under the heat blower 1 via a ground stand 6. In order words, the heat blower 1 is provided on the ground stand 6, two or more pedestals 7 are provided under the ground stand 6, and one or more rolling wheels 8 are further provided on the pedestal 7.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A shed type clothes dryer, comprising:

a heat blower for generating heated air flow;

an air outlet shed provided on top of said heat blower, wherein said air outlet shed has a plurality of air outlets radially provided at a peripheral edge of said air outlet shed;

a support frame which comprises a center supporting stand upwardly extended from said air outlet shed;

an outer cover encircling with said support frame to form a clothes drying chamber within said outer cover, and a safety ventilating member comprising a circular plate supported above said air outlet shed and defining an air buffer chamber between said a circular plate and said air outlet shed, wherein said clothes drying chamber is defined above said circular plate, wherein said circular plate has a center hole for said center supporting stand slidably coupling thereat, a water proof zone defined at a center portion of said circular plate, and a plurality of ventilating holes provided at said circular plate out of said water proof zone, wherein a diameter of said water proof zone is larger than a diameter of said air outlet shed.

2. The shed type clothes dryer, as recited in claim 1, wherein said water proof zone of said circular plate is a non-holed zone that said ventilating holes are formed out of said non-holed zone.

3. The shed type clothes dryer, as recited in claim 1, wherein said circular plate has a protruding convex surface formed at said water proof zone that said protruding convex surface is protruded toward said clothes drying chamber.

4. The shed type clothes dryer, as recited in claim 2, wherein said circular plate has a protruding convex surface formed at said water proof zone that said protruding convex surface is protruded toward said clothes drying chamber.

5. The shed type clothes dryer, as recited in claim 1, wherein said circular plate further comprises a water proof ridge upwardly extended at a peripheral edge of said center hole and coupled with said center supporting stand, and a water guiding ridge downwardly extended from a bottom side of said circular plate at a peripheral edge of said water proof zone thereof, wherein a diameter of said water guiding ridge is large than said diameter of said air outlet shed.

6. The shed type clothes dryer, as recited in claim 2, wherein said circular plate further comprises a water proof ridge upwardly extended at a peripheral edge of said center hole and coupled with said center supporting stand, and a water guiding ridge downwardly extended from a bottom side of said circular plate at a peripheral edge of said water proof zone thereof, wherein a diameter of said water guiding ridge is large than said diameter of said air outlet shed.

7. The shed type clothes dryer, as recited in claim 4, wherein said circular plate further comprises a water proof ridge upwardly extended at a peripheral edge of said center hole and coupled with said center supporting stand, and a water guiding ridge downwardly extended from a bottom side of said circular plate at a peripheral edge of said water proof zone thereof, wherein a diameter of said water guiding ridge is large than said diameter of said air outlet shed.

8. The shed type clothes dryer, as recited in claim 1, further comprising a water proof cover provided on top of said air outlet shed, wherein a size of said water proof cover is larger than said diameter of said air outlet shed.

9. The shed type clothes dryer, as recited in claim 4, further comprising a water proof cover provided on top of said air outlet shed, wherein a size of said water proof cover is larger than said diameter of said air outlet shed.

10. The shed type clothes dryer, as recited in claim 7, further comprising a water proof cover provided on top of said air outlet shed, wherein a size of said water proof cover is larger than said diameter of said air outlet shed.

11. The shed type clothes dryer, as recited in claim 1, further comprising a support seat located on top of said air outlet shed, wherein said circular plate is supported by said support seat to support said circular plate above said air outlet shed.

12. The shed type clothes dryer, as recited in claim 4, further comprising a support seat located on top of said air outlet shed, wherein said circular plate is supported by said support seat to support said circular plate above said air outlet shed.

13. The shed type clothes dryer, as recited in claim 10, further comprising a support seat located on top of said air outlet shed, wherein said circular plate is supported by said support seat to support said circular plate above said air outlet shed.

14. The shed type clothes dryer, as recited in claim 1, further comprising a plurality of positioning posts distributed along a peripheral edge of said circular plate and a plurality of positioning holes provided within said outer cover, wherein said positioning posts are coupled at said positioning holes respectively to support said circular plate by said outer cover at a position above said air outlet shed.

15. The shed type clothes dryer, as recited in claim 4, further comprising a plurality of positioning posts distributed along a peripheral edge of said circular plate and a plurality of positioning holes provided within said outer cover, wherein said positioning posts are coupled at said positioning holes respectively to support said circular plate by said outer cover at a position above said air outlet shed.

16. The shed type clothes dryer, as recited in claim 10, further comprising a plurality of positioning posts distributed along a peripheral edge of said circular plate and a plurality of positioning holes provided within said outer cover, wherein said positioning posts are coupled at said positioning holes respectively to support said circular plate by said outer cover at a position above said air outlet shed.

17. The shed type clothes dryer, as recited in claim 13, wherein said circular plate comprises a circular affixing ring and a flexible air-meshed cloth affixed to said affixing ring in a tensional manner.

18. The shed type clothes dryer, as recited in claim 16, wherein said circular plate comprises a circular affixing ring and a flexible air-meshed cloth affixed to said affixing ring in a tensional manner.

19. The shed type clothes dryer, as recited in claim 13, wherein said circular plate comprises a circular affixing ring and a netted screen affixed to said affixing ring in a tensional manner.

20. The shed type clothes dryer, as recited in claim 16, wherein said circular plate comprises a circular affixing ring and a netted screen affixed to said affixing ring in a tensional manner.

* * * * *